US005588651A

United States Patent [19]

Frost

[11] Patent Number: 5,588,651

[45] Date of Patent: Dec. 31, 1996

[54] HAND ACCESSORY FOR SWINGING AN IMPLEMENT HANDLE

[76] Inventor: John H. Frost, 6900 Canby Ave.-#110, Reseda, Calif. 91335

[21] Appl. No.: 539,215

[22] Filed: Oct. 5, 1995

Related U.S. Application Data

[63] Continuation-in-part of Ser. No. 262,242, Jun. 20, 1994, abandoned.

[51] Int. Cl.[6] ..... A63B 57/00

[52] U.S. Cl. ..... 473/206; 2/20

[58] Field of Search ..... 273/165, 166, 273/25, 26 R, 26 C, 81 D, 67 B, 75, 67 DB, 81 R; 74/551.9; 16/DIG. 18, DIG. 19, DIG. 12; D8/DIG. 6, DIG. 7, DIG. 8; 280/821, 822; 2/16–21; 473/206

[56] References Cited

U.S. PATENT DOCUMENTS 5,322,286 6/1994 Frost ..... 273/165

*Primary Examiner*—Sebastiano Passaniti
*Attorney, Agent, or Firm*—Jack C. Munro

[57] ABSTRACT

A hand accessory contoured to fit primarily within the trailing hand of a pair of hands that are usable to swing a handle of an implement such as a baseball bat. The hand accessory extends between the web portion of the hand and the little finger of the hand. The hand accessory is contoured to be comfortable within the hand and to maximize speed and control of the swing to impart increased power with increased control of flight to a baseball which is struck with a baseball bat that is swung utilizing the hand accessory of this invention.

30 Claims, 4 Drawing Sheets

HAND ACCESSORY FOR SWINGING AN IMPLEMENT HANDLE

REFERENCE TO PRIOR APPLICATION

This application is a continuation-in-part of U.S. patent application Ser. No. 08/262,242, filed Jun. 20, 1994 by the same inventor now abandoned.

BACKGROUND OF THE INVENTION

1) Field of the Invention

The field of this invention generally relates to the hand accessories useful for improving power transmission and improving control of swinging movement between the hands of a human and the handle of an implement such as a baseball bat, thereby transmitting a greater amount of power and control of flight to a baseball that is struck with the baseball bat.

2) Description of the Prior Art

The subject matter of the present invention is an improvement over the structure defined within U.S. Pat. No. 5,069,454, issued Dec. 3, 1991, U.S. Pat. No. 5,180,165, issued Jan. 19, 1993, both carrying the title HAND ACCESSORY and both invented by the present inventor, and additionally U.S. pending patent application Ser. No. 07/937,108, filed Aug. 31, 1992, by the same inventor.

The concept of the present invention is going to be discussed in terms of swinging of a baseball bat. However, it is to be considered to be within the scope of this invention that this invention could be applied in conjunction with any implement for swinging or gripping that implement as required.

When swinging a baseball bat, there is a certain amount of pivoting of the bat relative to each hand of the user. The user places both hands on the baseball bat with the hand located nearest the butt of the baseball bat being defined as the leading hand, and the hand located above the leading hand (nearer the striking area of the bat) being defined as the trailing hand. The center of the pivoting action is near the middle of the palm of each hand. The portion of the bat extending from the middle of the palm upward toward the contact area of the bat will move away from the body of the user during the swinging motion with the portion of the bat extending from the middle of the palm downward toward the butt of the bat moving relatively toward the body of the user. This rotational movement occurs at the start of the swing just after the bat leaves the "cocked" position. As the hands moving at the wrist attempt to propel the bat forward, not only does the palm, web area and upper fingers of the hand push outward, but the hands tighten their grip with the lower two fingers and knuckles pulling and moving inward (toward the user). At this time, there is a strain on the ring and little fingers of the hands in attempting to bring about this rotation of the bat as the inertial force of the bat is moving against those fingers.

The human hand is not designed exclusively for gripping round, thin handles. A thin handle may be defined as smaller in diameter than the distance between the index finger knuckle (third joint) and the thumb knuckle (second joint) when gripping the handle. In swinging a round, thin handled bat, certain tough, muscular areas of the hand never touch, touch minimally or touch only momentarily the handle during gripping and swinging, so power transfer from these muscular areas is lost. When swinging a baseball bat, for the trailing hand, it is preferable to grip with the fingers. It is difficult to maintain such a grip, however, as the thin handle tends to fall backwards by inertia out of the fingers into the web between the index knuckle and thumb knuckle when the hand is attempting to propel the handle forward. The web is a low-density space which contains no bone or muscle. As the bat handle inertially moves momentarily from the fingers back into this web of skin, the user loses power and control int he swinging movement. Also, force received by this area of the hand produces greater strain on the wrist than when the force is contained in the mid-palm and tough ball area. Just immediately prior to impact or even just after impact, the handle will return into the fingers as it catches up to the forward motion of the hand. However, power and control have been lost At the force of impact, if the ball does not strike the optimal point (or "meat") of the bat, the bat will again recoil slightly into the web compressing such, this compressing of the web absorbs and dissipates energy otherwise transmissible to the ball thus causing a weaker strike of the ball.

A similar phenomenon resulting in loss of power and control occurs in the concave mid-palm area. Other potential power areas of the hand that are not in full contact with the thin handle are the lower base of the thumb along the lifeline and part of the tough ball area below the little finger.

There is a need for a device to improve control and force transmission between the hand and a thin-handled instrument. The device should also reduce strain on the fingers. The present inventor has obtained U.S. Pat. Nos. 5,069,454 and 5,180,165 and has a U.S. patent pending Ser. No. 07/937,108, previously mentioned, all of which are directed toward the elimination of the above-described weakness of the human hands when gripping to swing a thin-handled instrument. Success was achieved in the aforementioned patents for the lead hand (left for right-hand hitter and right for left-hand hitter) in the swinging motion. However, the present inventor encountered difficulty in obtaining the maximum efficiency within the trailing hand (right hand for a right-hand hitter and left hand for a left-hand hitter). The primary difference in the right hand is the need to position the bat further out in the fingers which results in many different problems that had to be overcome. These problems are further explained in the Specification and some of their solutions were found to be adaptable to some degree to improvements in the left hand device. It should be noted that the focus on the right or trailing hand is not to the exclusion of the left or leading hand.

It was found that comfort could not be accomplished by merely rounding, reducing or softening the amount of material in the affected areas. Every section of the hand accessory device had to be formed and angled correctly in order to bring about perfect distribution of force throughout the strong and weak, tough and sensitive areas of the hands. Through further analysis of the gripping hand and use of a radar gun, several changes in angles and shapes of the prior art devices have been discovered to provide greater speed of the bat and more uniform distribution of force through the hands. Thus, the intent of the present application is to redefine the prior art devices shown and described within the aforementioned U.S. patents and U.S. patent pending to improve the performance of these prior art devices.

It was found that power transfer to the handle comes not only from the wrists moving the hand forward and the fingers tightening (as described earlier), but from certain movements within the hands themselves. When these certain movements were discovered and identified, the correct angles and features of the current device were obtained. Analyzing the correct grip and swing, in stage one, as the trailing (right) hand fingers grip the handle, the hand rolls inward to the left and the fingers turn somewhat sideways to the handle. The palm deepens, especially in the "hollow" area below the ring finger. The index finger knuckle (third) joint moves left almost to the inside of the handle as in a golf grip. The handle is now angled to lie below the little finger third joint and above the index finger third joint. This grip provides the fastest possible swing of the bat, but there is a problem. In stage two of the swing, as the trailing hand attempts to overcome inertia at the cocked bat stage, the hand squeezes the handle harder than during the initial grip. At this time, most hitters are trying to get as much of the muscular ball and other strong areas of the hand against the handle as possible, though this may not be consciously apparent to them. The knuckles remain relatively fixed to the handle, while the entire lower portion of the hand moves upward and inward toward the handle and fingers. It is a hinge-like motion occurring primarily along the main transverse crease just below the knuckle area. There is a further pivoting at the secondary transverse crease, as the index finger rotates right, or clockwise, away from the handle, just as the ball, heel, thumb base, thumb and web are moving up and toward the handle. As the index knuckle moves past the handle, it is no longer in a supporting position of the handle. The handle now lies partially into the web, with nothing to stop it from rocking further backwards deep in the web other than the strength of the lower portion of the trailing hand, and of course, the leading hand. Once the bat is in forward motion, the trailing hand rotates backward (counterclockwise), flattens out, and appears more like a hammer grip as the ball impacts the bat. This stage is of less importance since most of the power has been transferred prior to this. However, as the index knuckle rotates back toward the handle, the accuracy of the swing may be impaired as the knuckle pushes upward on the handle causing the bat to strike too high on the ball. Another reason for designing the present invention is to keep the handle away from the index knuckle and web areas.

The recognition of stage two, where the trailing hand rotates counterclockwise with the lower portion of the trailing hand moving towards the handle and the top knuckle area moving away from (or past) the handle, may explain why great hitters disagree over how hard the hands should squeeze. Those who prefer a loose grip are probably able to keep the handle further out in the fingers, which is an advantage, but those hitters also lose some power from the lower portion of the trailing hand. The reverse would be true of those who prefer a tight squeezing of the handle. In the current invention, the right structure has been found to harness the above and previously described motions of the hands and wrists in order to obtain power transfer from all strong portions of the hand while still maintaining the handle in the fingers above the index finger knuckle area away from the web, thus achieving optimum power transfer and accuracy of swing.

SUMMARY OF THE INVENTION

Both embodiments of this invention is a hand accessory in the form of a semi-solid mold or plug designed to fill the triangularly shaped palm of the hand gripping and squeezing an implement handle. This plug covers certain areas of the hand in such a way as to transmit increased power from those areas to the handle such that the force of the handle by inertia is received more by the stronger areas of the hand than by the web, index knuckle or thumb joints. The back surface of the plug, which is in direct contact with the hand, contains a plurality of specifically arranged concave areas and ridges each of which is to connect with a specific area of the hand. The plug has ridges and protrusions to connect with certain creases, fleshy areas and concave areas of the hand. The plug includes a flange to be positioned against the thumb and base of the thumb and a flange which arches around the ball and heel of the hand increasing stability and harnessing power. The plug is constructed to have a certain amount of flexibility permitting some deflection to allow for certain hand movements to occur when the user tightens his or her grip on the handle, thereby maximizing comfort, stability and power transfer in the gripping and swinging motion of the handle. The hand accessory may be worn unobserved under a batting glove.

BRIEF DESCRIPTION OF THE DRAWINGS

FIG. 8 is a diagrammatic depiction of a human hand depicting the different areas of the hand that the hand accessory works in conjunction with;

DETAILED DESCRIPTION OF THE SHOWN EMBODIMENT

The use of a plug type of accessory to be placed within the hand when swinging of a baseball bat has been discussed within the aforementioned U.S. Pat. Nos. 5,069,454 and 5,180,165 and U.S. patent pending Ser. No. 07/937,108. U.S. Pat. Nos. 5,069,454 and 5,180,165 were directed principally to the leading hand and the use of a hand accessory in conjunction with leading hand. It has been found that if a hand accessory is designed properly to be used in conjunction with the trailing hand, a further increase in power and control in swinging of the baseball bat can be achieved.

It has been found that a subtle, though important, difference in shape is required within the hand accessories for each hand in order to provide maximum performance. This is due to several factors such as (1) the difference in the angle of each hand gripping the bat, (2) the trailing hand having to reach farther than the leading hand at the point of impact with the baseball, which is one reason why the bat handle is held further out in the fingers which causes (3) the thumb to extend further into the web area, pushing the bat further out into the fingers, thus reducing the web size, creating more defined and acute angles and creating more difficulty in achieving balance, since the farther the handle is from the wrist, the greater the potential instability of the grip, (4) the difference in shape of the bat handle along the length of the hand accessory, and (5) the dynamics of the swing itself since the leading hand initiates the swing and is pulling while the trailing hand is pushing to catch up. All of the above causes the force to be received to a greater extent at the bottom area of the leading hand and to a greater extent at the top area of the trailing hand. This force tends to push the hand accessory down and away from its correct position which causes loss of power. The present invention seeks to redistribute this force to stronger areas of each hand, over a larger area of each hand, and to "lock" into the hand with a plug (or mold) by locating and filling with the hand accessory plug as many tough, concave and/or fleshy areas as possible while avoiding all of the sensitive areas of the hand.

Figure 8:
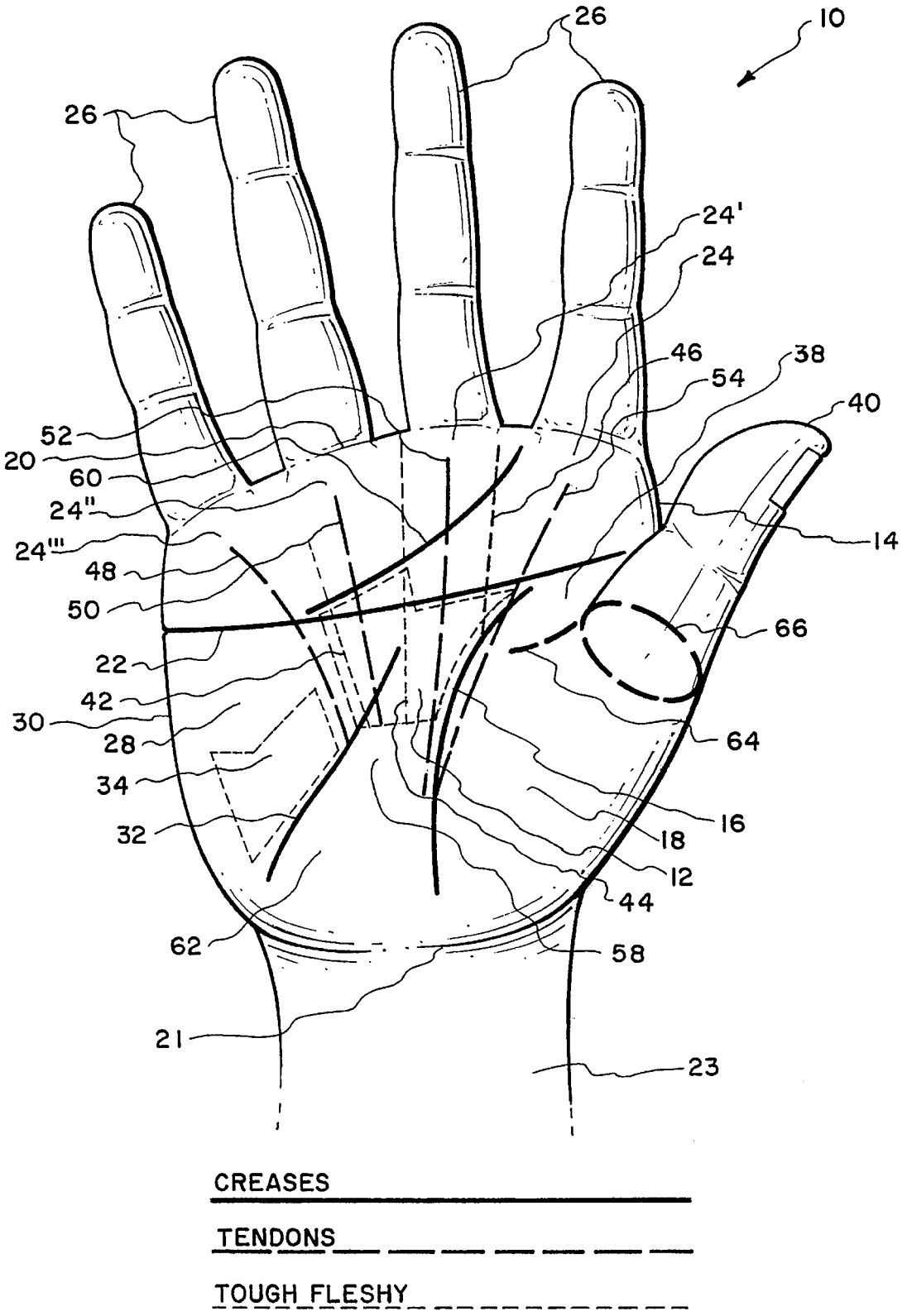
Figure 9:
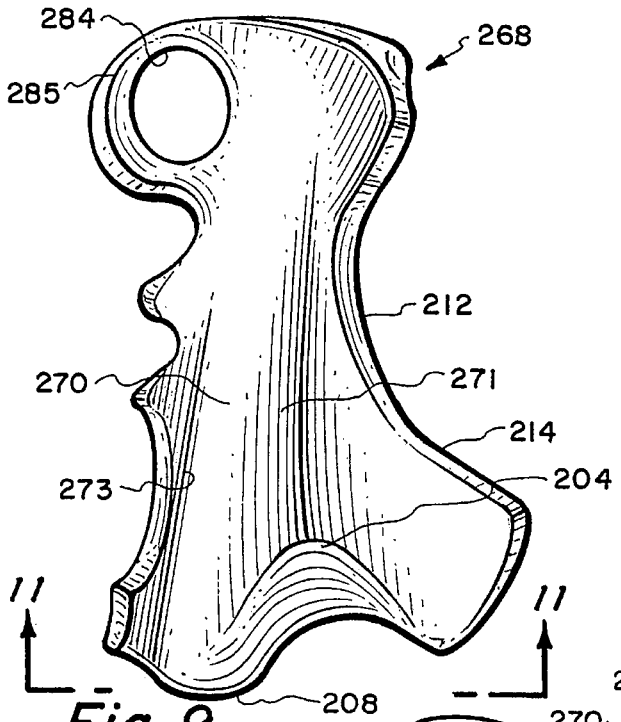
FIG. 9 is a front view of a second embodiment hand accessory of this invention.
Figure 10:
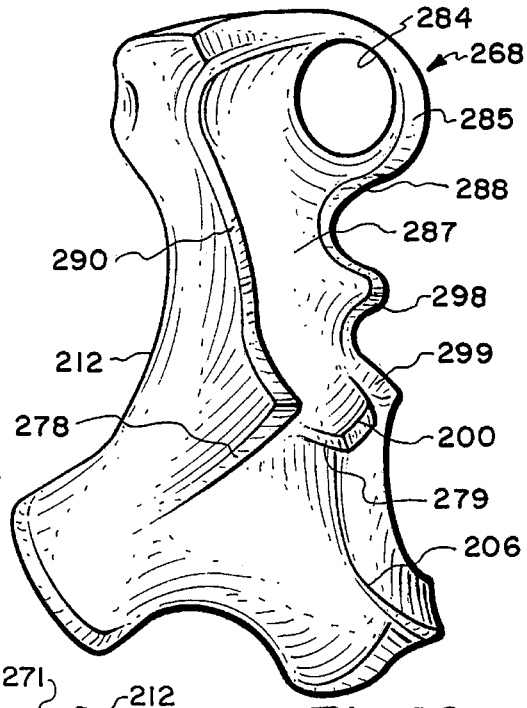
FIG. 10 is a rear view of the second embodiment hand accessory of this invention.
Figure 11:
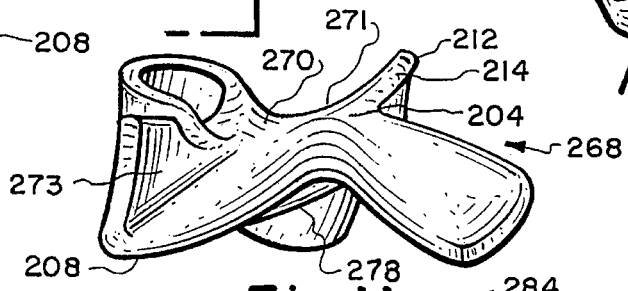
FIG. 11 is a bottom view of the second embodiment hand accessory of this invention taken along line 11—11 of FIG. 9.
Figure 12:
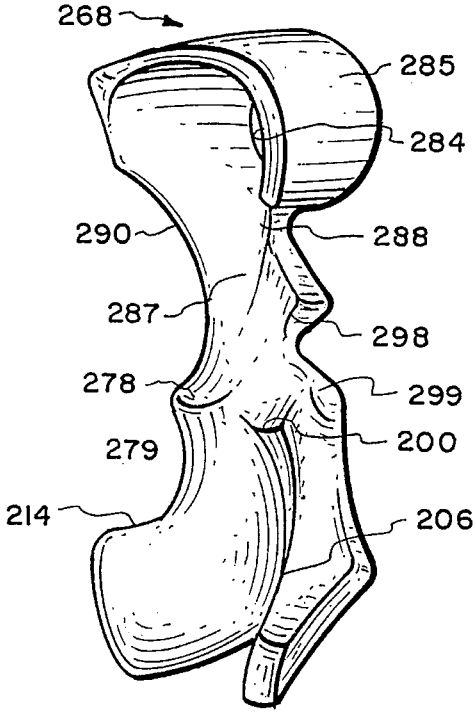
FIG. 12 is a right side view of the second embodiment hand accessory of this invention.
Figure 13:
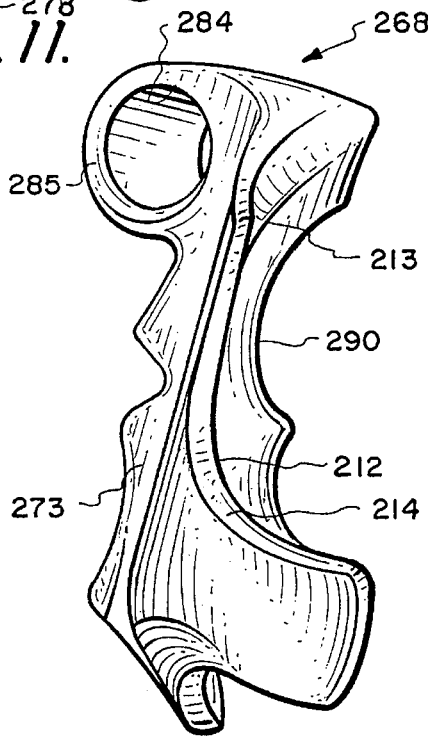
FIG. 13 is a left side view of the second embodiment hand accessory of this invention.

For the purpose of description within FIG. 8, the gripping hand 10 is shown in an almost fully open position. For directional purposes, the area of top, bottom, inside and outside shall be used to apply to the coinciding areas of the hand 10 and plug 68, the top 20 being in the direction of the fingers 26, bottom 21 being in the direction of the wrist 23, inside 14 being directly adjacent web 38, and outside 30 directly adjacent the ball 28. The fingers 26 include an index finger, a middle finger, a ring finger and a little finger. The knuckle 24 is the third joint of the index finger. The knuckle 24' is the third joint of the middle finger. The knuckle 24" is the third joint of the ring finger and knuckle 24''' is the third joint of the little finger. The gripping hand forms a triangular shape which includes primarily though, concave palm 12, with one side of the triangle being on the inside 14 and bottom 21 of the palm 12 bordered by the lifeline crease 16 at the fleshy, muscular base 18 of the thumb 40. The opposite side of the triangle is at the top of the palm 12 bordered by the transverse crease 22 and the secondary transverse crease 60 just below the fleshy knuckle area. The base of the triangle is adjacent the protruding, tough ball 28 at the outside 30 of the palm 12 below the little finger of fingers 26. In the fleshy tough ball 28, between the main transverse crease 22 and the diagonal crease 32 is the tough ball fold area 34 which becomes more apparent during the previously described hinge-like pivoting of the hand 10 when squeezing the handle 36.

The sensitive areas of the hand 10 are the sensitive heel area 58, the fingers described as finger tendons 48, 50, 52 and 54, the knuckles 24, 24', 24" and 24''', the thumb tendon 64 and the thumb second joint 66. A tougher heel area 62 lies below the sensitive heel area 58. During squeezing, the web 38 moves in conjunction with the thumb 40 producing fleshy locking areas along the lifeline crease 16. Within the palm 12 are further locking areas which are the troughs 42, 44 and 46 between the finger tendons 48, 50, 52 and 54, respectively. The index finger trough 46 and middle finger trough 44 extend from the top 20 of the hand and end near the bottom of the palm 12. The ring finger trough 42 also ends near the bottom of the palm 12, but during gripping extends only partially to the top 20 of hand 10. These troughs ar filled by ridges in the plug which is explained further in this specification. Upon gripping, the ring finger trough 42 deepens to the deepest area of palm 12.

The plug 68 will normally be constructed of a rubber material. For purposes of description, the plug 68 is shown mounted within the right hand 10 of a human. The fingers 26 and the thumb 40 are wrapped around the handle 36 as shown in Figure . The relevant portions of the hand 10 that are shown are the tougher heel area 62, thumb base 18, knuckle 24 and top portion of web 38. For purposes of description within FIG. 1, the hand 10 is shown being located very near the butt 76 of the handle 36. In actual practice, the trailing hand 10 will be spaced a somewhat further distance from the butt 76 so as to permit the leading hand (not shown) to engage with the handle 36 in between the trailing hand 10 and the butt 76.

Plug 68, in order to be effective, must be positioned within the hand 10 in the area of the knuckles 24, 24', 24" and 24'''. It is important that the plug 68 remain in that position. When the handle 36 is swung, there will be a natural tendency for the plug to move away from the knuckles 24, 24', 24" and 24''', due to the forward movement of the hand against the bat's inertia. Any movement away from the knuckle area will substantially decrease the effectiveness of the plug 68. The plug 68, forming the hand accessory of this invention, has a front surface which includes an elongated open-ended channel 70 which has a longitudinal center axis 72. The handle 36 of the baseball bat is to be located within the channel 70. The baseball bat handle 36 has a longitudinal center axis 74. The axis 74 is to be essentially parallel to the axis 72.

The channel 70 of the plug 68 is slightly arcuate. Channel 70 extends across the web 38 to become part of a web flange 113 and curved flange 114 which rest against thumb 40 and thumb base 18, respectively. The bottom of channel 70 deflects when squeezing pressure is applied by the hand against the handle 36. This deflection allows power to be obtained from the squeezing, hinge-like pivoting motion of the hand and causes the channel 70 to further conform to the handle 36 insuring that the handle 36 is held in the position of contact with the knuckle area and fingers 24.

Figure 4:
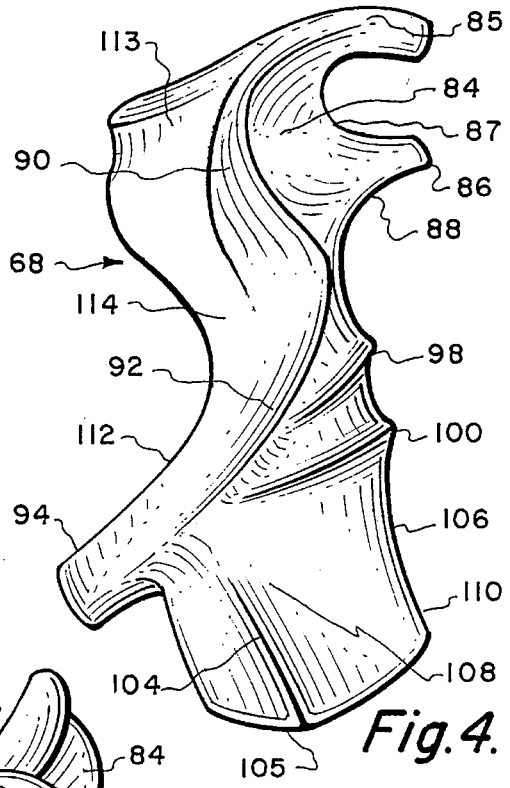
FIG. 4 is a rear view of the first embodiment hand accessory of this invention.
Figure 5:
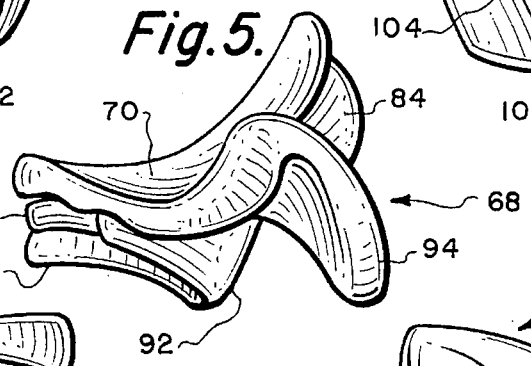
FIG. 5 is a bottom view of the first embodiment hand accessory of this invention.
Figure 6:
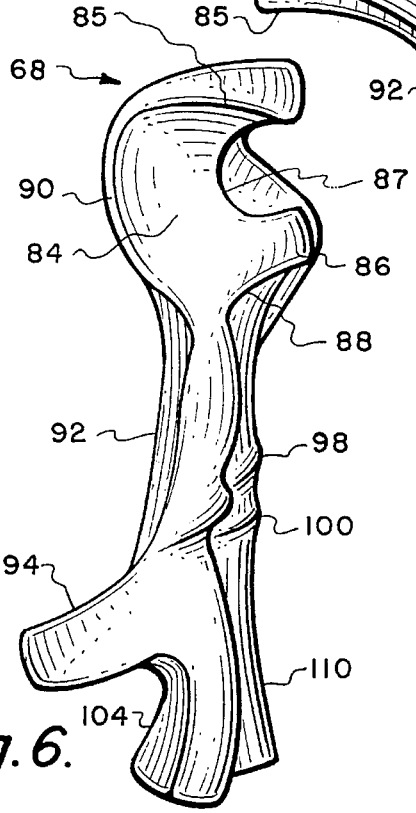
FIG. 6 is a top frontal side view of the first embodiment hand accessory of this invention.
Figure 7:
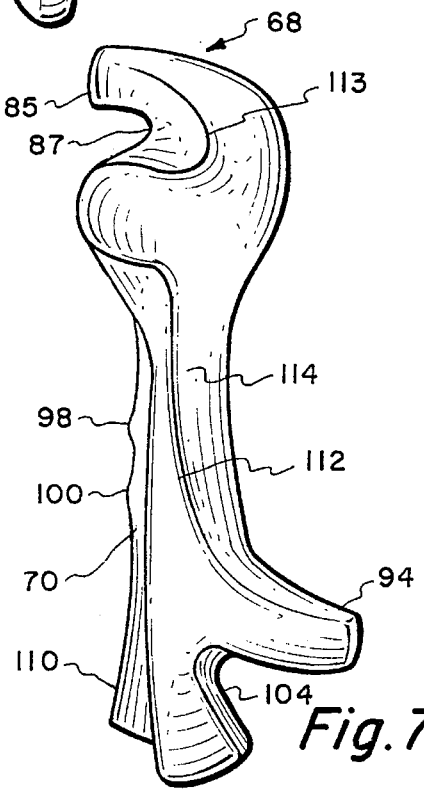
FIG. 7 is a bottom rear view of the first embodiment hand accessory of this invention.

Referring particularly to FIG. 4 of the drawings the surface of the plug 68 that is in direct contact with the user's hand is shown. The index finger knuckle 24 rests within a locking recess 84. Positioned against the index finger 26 is a protuberance 86. In between the knuckle 24 and the knuckle 24' is located a ridge 88 filling trough 46 and connecting with protuberance 86. At the inside 14 of hand 10 lies the edge 85 of locking recess 84. Edge 85 in conjunction with ridge 88 form concave edge opening 87 which is smaller than locking recess 84 in order to prevent knuckle 24 from moving toward handle 36 when force is applied. Edge 85 partially extends around index finger 26. Edge 85 is recessed to allow clearance for knuckle 24 so that when plug 68 is mounted within a batting glove 11, pressure from the glove 11 is not received by knuckle 24 so movement of edge 85 over finger 26 is not limited. Opening 87 is reduced in size by glove pressure thereby increasing the stabilizing effect of locking recess 84. Also assisting in this stabilization is a web ridge 90 which fills the fleshy crease where the lifeline crease 16 and transverse crease 22 intersect at the bottom of the knuckle joint 24 of the index finger 26. The area of curved flange 114, which extends across fleshy web 38 between thumb 40 and web ridge 90 and channel 70 is called the web flange 113. Web flange 113 is wider than the distance between index knuckle 24 and thumb second joint 66 during the gripping position of hand 10, helping to prevent plug 68 and handle 36 from recoiling back into web 38. Web flange 113 is recessed and thinned at the back surface of plug 68 above web **38*d* between thumb 40 and index finger 26 in order to reduce the amount of pull transferred to locking recess 84 and reduce the amount of force required for thumb 40 to bend curved flange 114 and web flange 113 toward handle 36 during the squeezing motion causing the front surface of web flange 113 to wrap around handle 36 holding handle 36 in proper position while allowing locking recess 84 to remain in its correct position. Web flange 113 is also shaped to avoid contgact with sensitive thumb joint 66 and thumb tendon 64, and could be further described as a prosthetic extension of web 38 as it is flexible enough to allow thumb 40** full movement so that a batter may position his thumb high and in against the handle or low and out on the fingers.

Still further stabilization is achieved by a ridge 92 which is to be located within the lifeline crease 16. This ridge 92 terminates in a protuberance 94 which is also to be located within the lifeline crease 16 directly adjacent the wrist 23. The thinness of ridge 92, as well as the protuberance 94, allow fleshy overlap which helps to maintain the stabilized position of the plug 68 within the hand 10.

Further stabilization is achieved by the use of ridge 98 which is located within the middle finger trough 44 and ridge 100 which is located within the ring finger trough 42. It is to be noted that the ridges 98 and 100 are short in length so as to not contact the forward moving sensitive heel area 58 during the squeezing motion. Ridge 104 functions to dig into the fleshy tough ball fold area 34 of the hand 10. Between the ridge 104 and the top surface 106 there is a concavity 108 that connects with the tough fleshy ball 28 allowing full forward motion of ball 28 during the hinge-like pivoting motion when hand 10 squeezes to maximum force, harnessing power at ridge 104 from the lower portion of ball 28 near diagonal crase 32 which otherwise would not come in contact wih handle 36. Not only does ridge 104 harness power from ball 28 moving upward and toward handle 26, it provides a solid anchoring for handle 26 against the gripping force of the little finger and ring finger so that a better grip can be obtained. Mounted at the top edge of concavity 108 is a transverse ridge 110 extending from ridge 100 to the outside of plug 68. Ridge 110 connects with the main transverse crease 22 below the little finger 26 adding power from both the trigger action of the lower fingers and the forward motion of ball 28 during the hinge-like pivoting (or counterclockwise rotation) of hand 10. Between the protuberance 94 and the bottom edge 112 is a curved flange 114. Curved flange 114 angles downward to edge 112 from lifeline ridge 92 and web flange 113 to allow muscular thumb base 18 full movement toward the handle 36 during squeezing with some overlap of edge 112 to further lock plug 68 in place.

This second embodiment hand accessory of this invention is shown in FIGS. 9–13. The visually apparent difference within the second embodiment when compared to the first embodiment is that the front surface channel arches forwardly (convexly) toward the handle 36, rather than curving concavely, as in the first embodiment. A less noticable difference is the back surface of the plug, which has a similar structure but is now designed to fit still further toward the fingers 26, with ridge pressing into finger troughs at the top of the hand (where the fingers exit the hand), rather than in the mid-palm area. There is empty cavity in the plug between the ridges of the transverse crease area (upper palm area) of the hand which causes a fleshy fold to protrude across the knuckle area in a tubular shape which helps "lock" the plug in place. Another apparent difference of the second embodiment is the structure which rings the index finger. It should be noted that this structure could also be used with the middle, as possibly, the ring finger. It should also be noted that the upper finger trough ridges could extend through the fingers to the back side of the hand spreading across the knuckles for further stability.

Figures 1, 2:
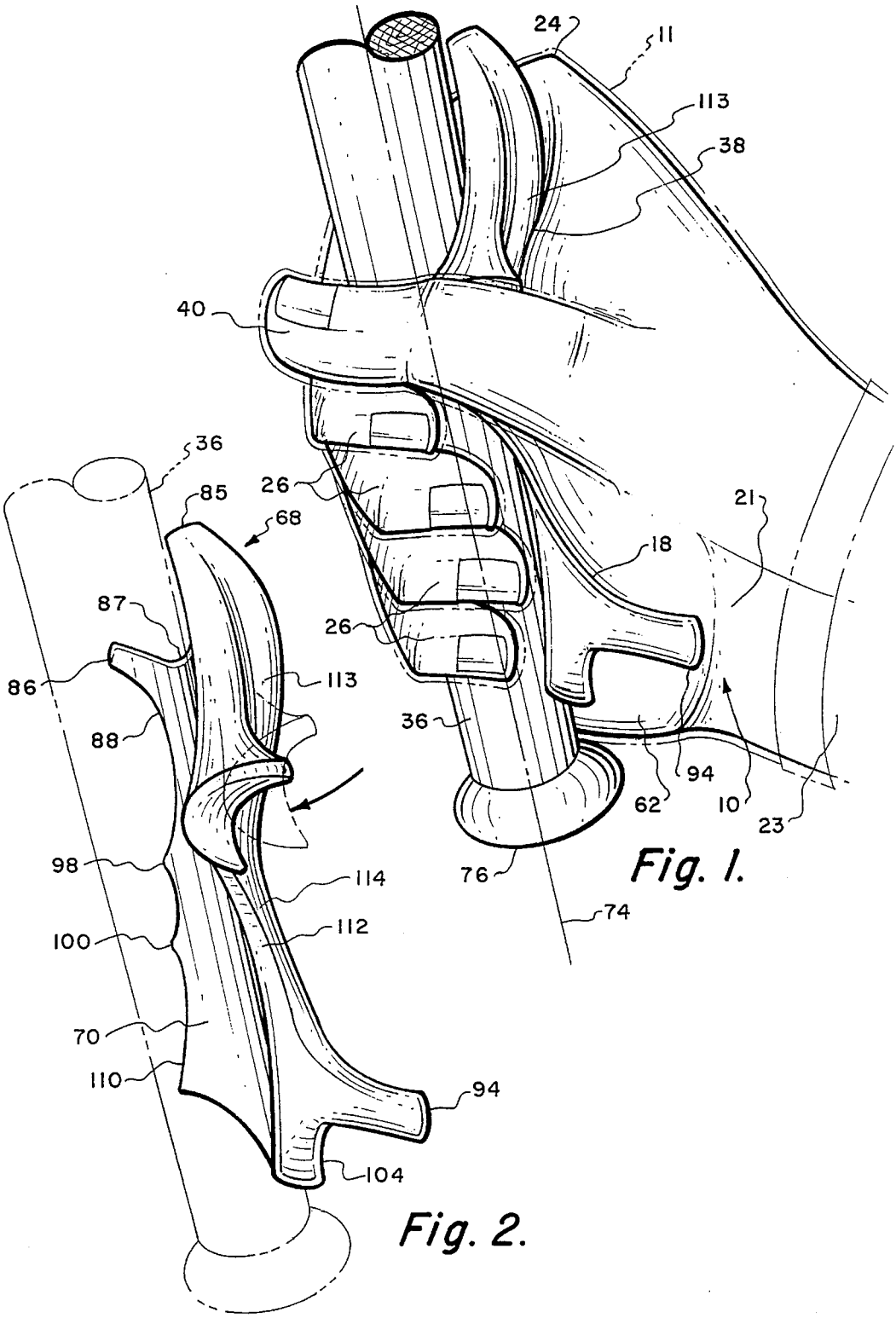
FIG. 1 is a front isometric view of a first embodiment hand accessory of the present invention showing the hand accessory being mounted within a human hand which is gripping the handle of a baseball bat.
FIG. 2 is a front isometric view similar to FIG. 1 but showing the baseball bat in phantom and the hand removed.
Figure 3:
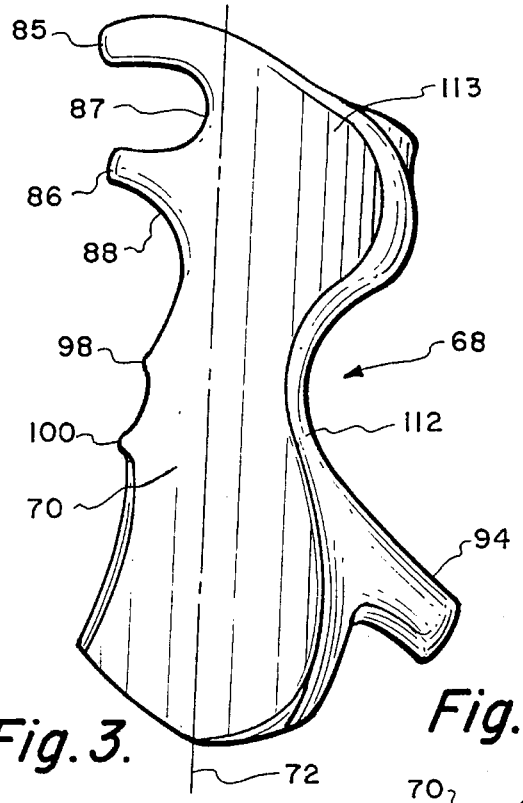
FIG. 3 is a front view of the first embodiment hand accessory of this invention.

Referring particularly to FIGS. 9–13, the plug 268 is to be mounted within the hand as is basically shown in FIG. 1 of the drawings. The larger area 271 of the channel 270 of plug 268 extends from transverse crease 22 of the hand toward the web 38 and the bottom 21 of the hand 10. This larger area 271 is flat to slightly convex in configuration, becoming greatly convexed above the sensitive heel area 58 of the hand. The smaller area 273 of channel 270 extends toward fingers 26 from the area of transverse crease 22. This smaller area 273 is slightly concave and roughly right angled to larger area 271. Channel 270 extends across the web 238 connecting with the back side of the plug 268 becoming part of web flange 213 and curved flange 214 which rests against thumb 40 and thumb base 18. Channel 270 has a low arch 208 which curves snugly over tough ball 28 transferring power from that area of the hand 10. Channel 270 also has a high arch 204 which curves higher over sensitive heel 58 avoiding contact from the sensitive heel 58. Curve flange 214 joins high arch 204 to force handle 36 toward ring and little fingers 26 and away from index knuckle 24 and web 38. Channel 270 deflects when squeezing pressure is applied by the hand against the handle 36. Aiding this deflecion is a deep trough (not shown) which is formed out of channel 270 directly adjacent smaller area 273 at the base of high arch 204. This deep trough allows larger area 271 to move closer to smaller area 273. This deflection allows power to be obtained from the squeezing, hinge-like, pivoting motion of the hand and causes the channel 270 to stretch, arch and partially conform to the handle 36 while pushing the handle 36 toward the right angled, small area 273 of channel 270, insuring that the handle 36 is held in the position of contact with fingers 26.

The index finger 26 is to be positioned within hole 284 with the index finger of fingers 26 locked tightly with plug 268. Positioned against the index finger of the fingers 26 is top ridge 288 which fills index finger trough 46 at the top area 20 of the hand 10 (where the fingers start). The portion of the plug 268 which surrounds hole 284 has an edge 285 which inhibits knuckle 24 from moving toward handle 36 when force is applied. Hole 284 is formed in such a way that glove pressure applies pressure on the index finger of the fingers 26 above sensitive knuckle 24, the back side of knuckle 24 (opposite side of palm) and on the top area of index finger trough 46 thereby securing in position the plug 268 in the hand 10. The area of curved flange 214 which extends across fleshy web 38 between thumb 40 and web rib 290 and channel 270 near index knuckle 24 is called the web flange 213.

Additional securement of the plug 268 in the hand 10 is achieved by the use of first top ridge 298 which is located within the middle finger trough 44 at the top area 20 of hand 10 and second top ridge 299 which is located within the ring finger trough 42 near the top area 20. It is to be noted that the ridges 298 and 299 are short in length so as to allow a hollow area called flesh fold cavity 287 into which are located the knuckles 24', 24' and 24''' during the squeezing motion. Further securement is achieved by deep ridge 200 which presses into the deepest area of concave palm 12 at the intersection of transverse crease 22 and upper transverse crease 60. Deep ridge 200 is part of trough ridge 279 which fills part of ring finger trough 42 inside of little finger tendon 48 and above sensitive heel 58. Trough ridge 278 fills part of middle finger trough 44. Deep ridge 200, part of trough ridge 278 and part of web ridge 290, are spaced from second top ridge 299, first top ridge 298 and third top ridge 288 respectively to form flesh fold cavity 287 causing the fleshy knuckle area to protrude increasing securement of the plug 268 in the hand 10. Also, defining the flesh fold cavity 287 is transverse ridge 206. Low arch 208 functions to contact the fleshy tough ball fold area 34 of the hand 10. The back surface of low arch 208 connects with transverse ridge 206 which fills the fleshy fold area of the transverse crease 22 below the little finger of the fingers 26 and extending to the deep ridge 200. Transverse ridge 206, deep ridge 200 and low arch 208 harness power from tough ball 28 causing such to move upward and toward handle 26 and provide a solid anchoring for handle 26 against the gripping force of the little finger and the ring finger of the fingers 26 so that a better grip can be obtained. The curved flange 214 extends to edge 212 from web flange 213 in a concave manner so as not to touch thumb base 18 until maximum gripping strength is applied allowing muscular thumb base 18 full movement toward the handle 36 during squeezing, with some overlap of edge 212 to further lock plug 268 in place.

What is claimed is:

1. In combination with the handle of an implement when said handle is to be manually swung in motion by the hand of a human with the hand gripping and squeezing said handle, the hand having a concave palm from which extend a thumb and fingers, the fingers named from the inside of the hand nearest the thumb being the index finger, the middle finger, the ring finger and the little finger, the hand having a plurality of tough fleshy areas, the hand having a plurality of sensitive areas, the hand having a web located between the base of the thumb and the index finger, the concave palm including a lifeline crease which in part contours the thumb base, the concave palm bordered by a transverse crease located directly adjacent and below the knuckles of the fingers, the concave palm bordered on the outside by a tough ball directly adjacent and below the little finger and bordered by a sensitive heel located below the tough ball directly adjacent the concave palm and a tougher heel located below the sensitive heel, the concave palm having several separate sensitive areas and several separate trough areas, the hand pivoting at the transverse crease during the squeezing of said handle such that the tough ball, heel and thumb base move in a direction toward said handle during the squeezing, a hand accessory to be positioned between said handle and the hand, said hand accessory comprising:

a plug having primarily a slightly arcuate front surface to engage with said handle, said plug having a back surface which is to press against the hand, said back surface of said plug having a plurality of curved surfaces and concave areas to engage the sensitive areas and to allow movement of said pivoting;

ridges and protrusions to engage the tough, fleshy areas serving to maintain position of said plug within the hand and resisting the inertial movement of said handle toward the web, a glove worn over the hand presses certain areas of said plug against the hand, said plug being bendable to permit deflection of said front surface during said pivoting of the hand so that said front surface closely conforms to said handle during the squeezing, whereby said plug facilitates the transmission of a manual swinging force between the hand and said handle; and said plug includes a locking recess, a portion of the index finger to fit within said locking recess, whereby said locking recess functions to locate the position of said plug within the hand such that force is transmitted through the fingers of the hand.

2. The combination as defined in claim 1 wherein:

said back surface includes a plurality of ridges, some of said ridges to engage with the trough areas.

3. The combination as defined in claim 2 wherein:

some of said ridges fill the trough areas between the little finger and the ring finger and the middle finger and the index finger in the palm area.

4. The combination as defined in claim 1 wherein:

said back surface includes a plurality of ridges, some of said ridges to engage with the fleshy areas.

5. The combination as defined in claim 4 wherein: one of the ridges engages with the tough ball.

6. The combination as defined in claim 5 wherein:

the area of said plug adjacent said ridges connecting with the tough ball extends concavely to said ridges that connect with the lifeline crease, with said troughs of the palm and little finger, said area allowing full movement of the ball and heel and thumb base toward said handle during the squeezing.

7. The combination as defined in claim 5 wherein:

said ridge that is engaging the tough ball is located parallel to said ridge that engages the transverse crease adjacent the little finger, both said ridges being spaced apart a distance to allow accommodation of said handle, said ridges providing increased gripping strength of the ring finger and the little finger during the squeezing.

8. The combination as defined in claim 7 wherein:

said ridge that engages the tough ball connects to a ridge that engages the tougher heel.

9. The combination as defined in claim 1 wherein:

said back surface includes a plurality of ridges, some of said ridges to engage with the transverse crease, said ridges being indented in the areas that connect with the sensitive areas of the tendons of the fingers.

10. The combination as defined in claim 9 wherein:

said back surface includes an index ridge which engages said trough between the knuckles of the index finger and the middle finger, said index ridge forming one side of said locking recess, the opposite side of said index ridge being an edge lying on the inside of the hand, said edge providing clearance for the knuckle of the index finger, said edge partially extending around the index finger, said edge to be pressured by said glove toward the index ridge causing a clamping of the index finger serving to prevent the knuckle from disengaging said locking recess thereby helping maintain the position of said plug.

11. The combination as defined in claim 9 wherein:

said ridges that engage the transverse crease are angled to increase the flexion of the ring finger and the little finger and decrease the flexion of the middle finger and the index finger.

12. The combination as defined in claim 1 wherein:

said back surface includes a lifeline ridge, said lifeline ridge to engage with the lifeline crease, the lifeline ridge ending at the transverse crease.

13. The combination as defined in claim 12 wherein:

said plug includes a curved flange, said curved flange allowing flexible contact with the thumb base, said curved flange causing said front surface to conform to said handle during the squeezing.

14. The combination as defined in claim 13 wherein:

the lifeline crease and the transverse crease forming an intersection, said locking recess includes a web ridge which engages with a fleshy crease produced by the web and the knuckle of the index finger at the intersection.

15. The combination as defined in claim 14 wherein:

said plug extends from the web ridge and the front surface at the index finger knuckle to the thumb connecting with said curved flange forming a web flange.

16. The combination as defined in claim 15 wherein:

said web flange is recessed and thinned at said back surface of said plug to reduce the amount of force required by the thumb toward said handle during the squeezing and to reduce the distortion on other areas of said back surface during the bending of said web flange such that said web flange increases the force against said handle during the squeezing.

17. The combination as defined in claim 15 wherein:

said curved flange extends from the lifeline ridge engaging the lifeline crease and said web flange to a concave area directly adjacent the thumb base, said concave area ending at a concave edge, said concave edge and said concave area contacting the thumb base near the lifeline crease while allowing the thumb and the thumb base full movement toward said handle during the squeezing and allowing fleshy overlap from the thumb base of said concave edge for further stability.

18. The combination as defined in claim 13 wherein:

said curved flange includes a protuberance, said protuberance being an extension of said lifeline ridge engaging the lifeline crease.

19. The combination as defined in claim 18 wherein:

said protuberance is thinned and arcuate at said back surface in the area of the sensitive heel, said protuberance becoming thickened and convex at said front surface such that contact with the thumb base and the lifeline crease during the pivoting increases the force against said handle.

20. The combination as defined in claim 1 wherein:

said back surface includes a plurality of channels, some of said channels to engage with the fleshy areas that protrude during the gripping.

21. The combination as defined in claim 20 wherein:

one of said channels lies at the finger side of the web ridge and the lifeline ridge ending at said ridge which fills the trough between the little finger and the ring finger, said channel also adding flexibility to the lifeline ridge and the web ridge.

22. In combination with the handle of an implement when said handle is to be manually swung in motion by a hand of a human with the hand gripping and then squeezing said handle as said handle is swung, the hand being connected to a wrist, the hand having a thumb and fingers, the connection of the thumb to the hand being at a thumb base, the finger of the hand nearest the thumb being defined as an index finger, the finger directly adjacent the index finger defined as a middle finger, the finger next in series and directly adjacent the middle finger being defined as a ring finger, the finger at the outside of the hand being defined as a little finger, the hand having tendons, the fingers having pivot joints known as knuckles, the hand having a web located between the thumb base and the knuckle of the index finger, the hand having a concave palm bordered by a lifeline crease which in part contours the thumb base and the web, the concave palm including a transverse crease located directly adjacent and below the knuckles, an upper transverse crease extends from the transverse crease to a portion of the palm located directly adjacent the index finger and the middle finger, the concave palm bordered on its outside by a tough ball directly adjacent and below the little finger, the concave palm bordered at its bottom by a heel located below the tough ball, the heel including a sensitive heel area located directly adjacent the concave palm and a tougher heel area located directly adjacent the wrist and the tough ball, the hand having a sensitive knuckle/tendon area for each finger with there being a trough area between each directly adjacent pair of the knuckle/tendon areas, the trough areas being defined from the inside to the outside of the hand as an index finger trough, a middle finger trough and a ring finger trough, the hand pivoting at the transverse crease and the upper transverse crease during the squeezing of said handle such that the tough ball, heel, concave palm, thumb base and web move in a direction toward said handle during the squeezing, a hand accessory to be positioned between said handle and the hand, said hand accessory comprising;

a plug having a front surface composed primarily of a channel to engage with said handle, said plug having a back surface which is to press against the hand, said back surface of said plug including ridges and protrusions to engage with the hand serving to maintain position of said plug in the hand and hold said handle in its correct position by applying pressure on said handle toward the fingers, said front surface of said plug being deflectable during said pivoting of the hand so that said front surface closely conforms to said handle during the squeezing, whereby said plug facilitates the transmission of a manual swinging force between the hand and said handle;

a first portion of the channel that contacts said handle is convex with a second portion being concave and a third portion being flat;

said second portion positioning said handle closer to the fingers during the squeezing; and said second portion connects with said first portion at primarily a right angle in direct alignment with the transverse crease below the knuckle of the little finger and in direct alignment with the upper transverse crease below the knuckle of the ring finger, said first portion serving to push said handle toward the fingers, a concavity formed in said back surface of said plug in alignment with said first portion enabling the thumb base in conjunction with the hand to have full gripping strength and provide clearance for the sensitive heel area during the squeezing, said first portion arching around the tough ball and the heel and the thumb base to facilitate the gripping and the squeezing, said first portion flattens, stretches and arches around said handle forming a secure connection with said handle when swung.

23. The combination as defined in claim 22 wherein:

said second portion and said first portion flattens forming a flat portion as such extend toward the area of the hand of the knuckle of the index finger and the web, said flat portion allowing the knuckle of the index finger and the web to move toward said handle achieving greater gripping strength of the hand with said handle and to absorb stress from said handle and to transmit greater force to said handle when swung.

24. The combination as defined in claim 22 wherein:

the palm having a deep concave area, said back surface including a deep ridge which is to be located within said deep concave area, said deep ridge extending along said ring finger trough toward the sensitive heel area.

25. The combination as defined in claim 23 wherein:

said back surface of said second portion of said channel arches inward from the knuckle of the little finger providing a flesh fold cavity for the knuckle and a fleshy protrusion.

26. The combination as defined in claim 24 wherein:

said back surface of said second portion includes a transverse ridge which is to be located within the transverse crease during the squeezing, the transverse ridge arching around the tough ball and extending over the tough ball at the outside of the hand serving to force the tough ball toward said handle for added transmission of power from the hand.

27. The combination as defined in claim 26 wherein:

said second portion at said back surface includes a first top ridge which presses against the ring finger trough above said deep ridge forming a first cavity between said top ridge and said deep ridge.

28. The combination as defined in claim 27 wherein:

said back surface further includes a second top ridge pressing against the middle finger trough, said second top ridge located directly adjacent the middle finger and the ring finger.

29. The combination as defined in claim 28 wherein:

said back surface includes a third top ridge pressing against the index finger trough, said third top ridge extending around the index finger forming a circular hole into which is to be located the index finger.

30. The combination as defined in claim 29 wherein:

a plurality of secondary ridges pressing against the middle finger trough and the index finger trough in the area of the upper transverse crease, said secondary ridges being spaced from said top ridges producing a second cavity therebetween into which a portion of the hand is to be located providing further securement for said plug.

* * * * *